US007933531B2

(12) United States Patent
Hayakawa

(10) Patent No.: US 7,933,531 B2
(45) Date of Patent: Apr. 26, 2011

(54) IMAGE FORMATION DEVICE

(75) Inventor: Atsushi Hayakawa, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 304 days.

(21) Appl. No.: 12/340,804

(22) Filed: Dec. 22, 2008

(65) Prior Publication Data

US 2009/0169233 A1 Jul. 2, 2009

(30) Foreign Application Priority Data

Dec. 27, 2007 (JP) ..... 2007-336993

(51) Int. Cl.
*G03G 15/00* (2006.01)

(52) U.S. Cl. ..... 399/74; 399/49; 399/121

(58) Field of Classification Search ..... 399/41, 399/49, 74, 98, 118, 121, 301
See application file for complete search history.

(56) References Cited

U.S. PATENT DOCUMENTS

| | | | |
|---|---|---|---|
| 6,321,044 | B1 | 11/2001 | Tanaka |
| 7,167,661 | B2 | 1/2007 | Hatakeyama et al. |

FOREIGN PATENT DOCUMENTS

| | | |
|---|---|---|
| JP | 2000-132050 | 5/2000 |
| JP | 2001-100597 | 4/2001 |
| JP | 2002-131997 | 5/2002 |
| JP | 2002-328571 | 11/2002 |
| JP | 2005-070676 | 3/2005 |
| JP | 2005-134726 | 5/2005 |

*Primary Examiner* — David M Gray
*Assistant Examiner* — Barnabas T Fekete
(74) *Attorney, Agent, or Firm* — Banner & Witcoff, Ltd.

(57) ABSTRACT

An electrophotographic image formation device comprises an image transfer unit (including an image transfer member) attached to a main body in a detachable manner, a density detecting unit including a detector unit and thereby detecting density of a developing agent transferred to the image transfer member, a protective cover which protects the density detecting unit not detecting the density by covering the detector unit, first and second reflecting parts (differing in reflectivity) formed in a part of the protective cover facing the detector unit, and a shifting unit which places the protective cover at a first position (with the first reflecting part facing the detector unit) when the image transfer unit has been attached to the main body while placing the protective cover at a second position (with the second reflecting part facing the detector unit) when the image transfer unit has not been attached to the main body.

13 Claims, 8 Drawing Sheets

OPEN POSITION

FIRST POSITION
(PROTECTIVE POSITION)

IMAGE FORMATION DEVICE

CROSS-REFERENCE TO RELATED APPLICATION

This application claims priority under 35 U.S.C. §119 from Japanese Patent Application No. 2007-336993 filed on Dec. 27, 2007. The entire subject matter of the application is incorporated herein by reference.

BACKGROUND

1. Technical Field

The present invention relates to an image formation device (e.g. printer) of the electrophotographic type, and in particular, to an image formation device including an image transfer unit (an image transfer belt, a belt unit for feeding a sheet such as paper, etc.) that is attached to the main body of the image formation device in a detachable manner.

2. Prior Art

In order to facilitate the maintenance of an image transfer unit (an image transfer belt, a feeding belt for feeding a sheet, etc.), a belt unit in which the feeding belt has been installed is attached to the main body in a detachable manner in an image formation device disclosed in Japanese Patent Provisional Publication No. 2002-328571 (hereinafter referred to as a "patent document #1").

SUMMARY OF THE INVENTION

However, after detaching the belt unit from the main body for the maintenance of the feeding belt, the user can erroneously end the maintenance without reattaching the belt unit to the main body.

In order to eliminate this problem, the image formation device of the patent document #1 is configured to check the presence/absence of the belt unit by use of a reflective optical sensor which detects the density of an image (developing agent) that has been transferred to the feeding belt.

However, with the method detecting the presence/absence of the belt unit by use of a reflective optical sensor, the possibility of false detection increases with time since the surface condition of the feeding belt changes (deteriorates) with time due to progress of staining and wearing of the belt with continued use.

The present invention, which has been made in consideration of the above problems, is advantageous in that an image formation device, capable of detecting the presence/absence of the image transfer unit without being seriously affected by the variation (deterioration) of the image transfer unit with time, can be provided.

In accordance with an aspect of the present invention, there is provided an image formation device of an electrophotographic type for forming an image on a sheet by transferring a developing agent to the sheet, comprising an image transfer unit which is attached to a main body of the image formation device in a detachable manner and includes an image transfer member to which the developing agent can be transferred, a density detecting unit which includes a detector unit having a light emitting unit and a light receiving unit and thereby detects density of the developing agent transferred to the image transfer member, a protective cover which protects the density detecting unit by covering the detector unit when the density detecting unit does not detect the density of the developing agent transferred to the image transfer member, a first reflecting part and a second reflecting part differing in reflectivity which are formed in a part of the protective cover facing the detector unit when the protective cover covers the detector unit, and a shifting unit which shifts the protective cover relative to the density detecting unit in conjunction with attachment/detachment of the image transfer unit to/from the main body. The shifting unit places the protective cover at a first position for letting the first reflecting part face the detector unit when the image transfer unit has been attached to the main body, while placing the protective cover at a second position for letting the second reflecting part face the detector unit when the image transfer unit has not been attached to the main body.

In the image formation device configured as above, the density detected by the density detecting unit varies depending on whether the image transfer unit has been attached to (i.e. installed/loaded/set in) the main body or not. Therefore, the judgment on whether the image transfer unit has been attached or not can be made based on the difference in the detected value.

Further, variation (deterioration) of the first and second reflecting parts with time is far less than that of the image transfer unit since they are a part of the protective cover covering the detector unit of the density detecting unit and are not used during the image formation.

Therefore, the image formation device is capable of detecting the presence/absence of the image transfer unit (i.e. whether the image transfer unit has been attached or not) by use of an already-existing density detecting unit, without being seriously affected by the variation (deterioration) of the image transfer unit with time.

Incidentally, the above expression "differing in reflectivity" can mean not only cases where the first and second reflecting parts differ in the so-called reflectivity (reflection coefficient) but also cases where the first and second reflecting parts differ in reflecting status of light due to difference in at least one of reflectivity, scattering coefficient and diffusivity.

The shifting of the protective cover (relative to the density detecting unit) by the shifting unit in conjunction with the attachment/detachment of the image transfer unit to/from the main body may be implemented in various ways. For example, the shifting unit may be configured to shift the protective cover mechanically in conjunction with the attachment/detachment of the image transfer unit, to shift the protective cover by use of an actuator which is driven by a signal generated by electrically detecting the attachment/detachment of the image transfer unit, etc.

According to a further aspect of the invention, there is provided an image formation device of an electrophotographic type for forming an image on a sheet by transferring a developing agent to the sheet. The image formation device is provided with a density sensor including a light emitting unit and a light receiving unit, a belt unit configured to be detachably attached to a main body of the image formation device, a cover movable with respect to the density sensor. The belt unit includes a belt to which the developing agent can be transferred and a pressing part. The cover includes a pressed part, a first reference surface and a second reference surface which are provided on a surface facing the light emitting unit. The cover is moved when the pressed part is pressed. The cover is urged by a spring toward a position at which the light emitted by the light emitting unit of the density sensor is incident on the second reference surface.

When the belt unit is loaded, the pressing part of the belt unit presses the pressed part of the cover to move the cover toward a position at which the light emitted by the light emitting unit of the density sensor is incident on the first reference surface. Further, when the belt unit is not loaded, the spring moves the cover to a position where light emitted by the light emitting unit of the density sensor is incident on the second reference surface.

In the image formation device configured as above, with use of the density sensor, whether the belt unit has been attached or not can be judged accurately.

Other objects, features and advantages of the present invention will become more apparent from the consideration of the following detailed description taken in conjunction with the accompanying drawings.

BRIEF DESCRIPTION OF THE ACCOMPANYING DRAWINGS

DETAILED DESCRIPTION OF THE EMBODIMENT

Figure 1:
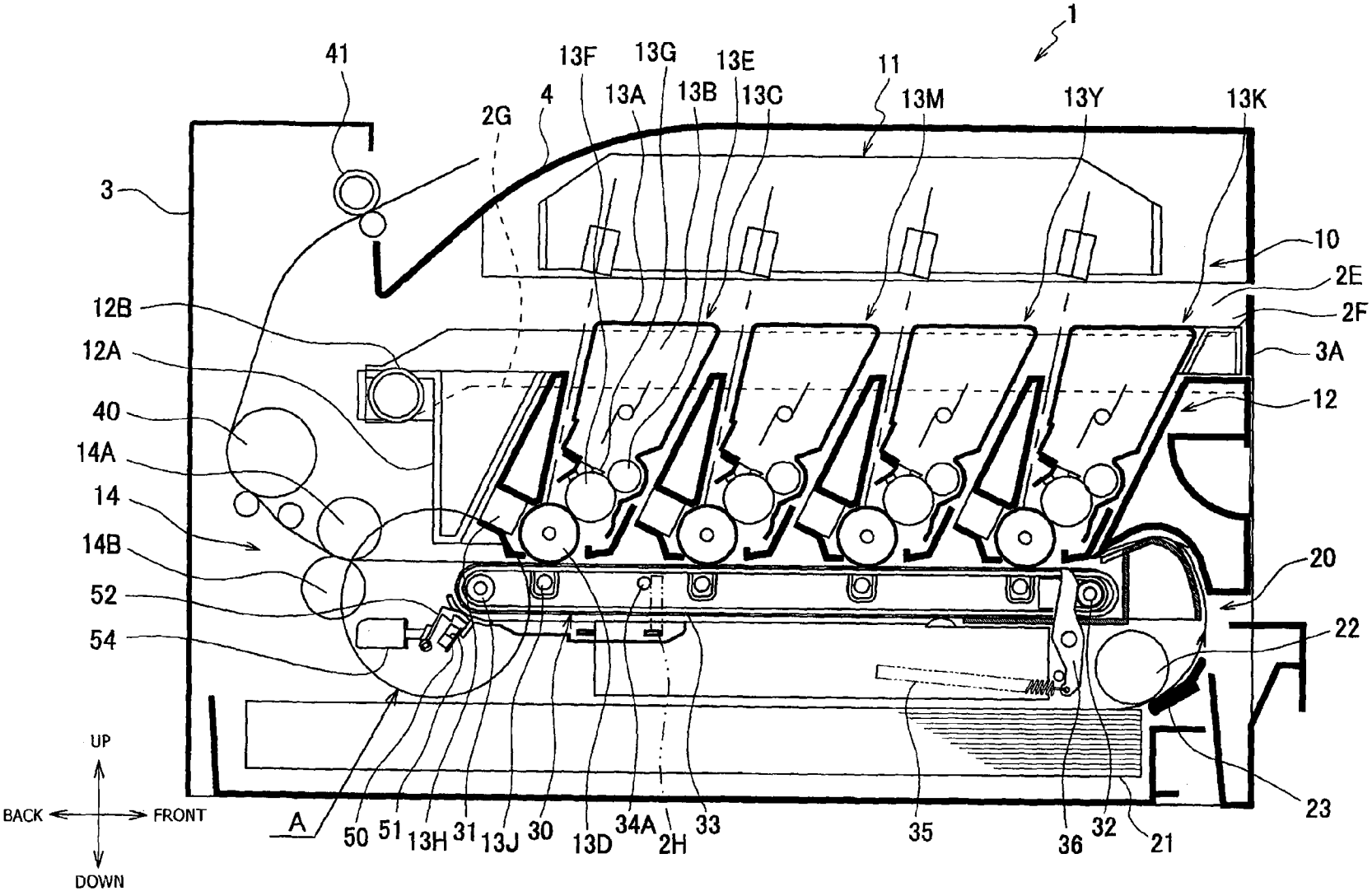
FIG. 1 is a central cross-sectional view showing the principal part of an image formation device in accordance with an embodiment of the present invention.

Referring now to the drawings, a description will be given in detail of a preferred embodiment in accordance with the present invention. In this embodiment, an electrophotographic image formation device in accordance with the present invention is implemented as a direct-tandem color laser printer.

<Configuration of Image Formation Device>

Figure 2:
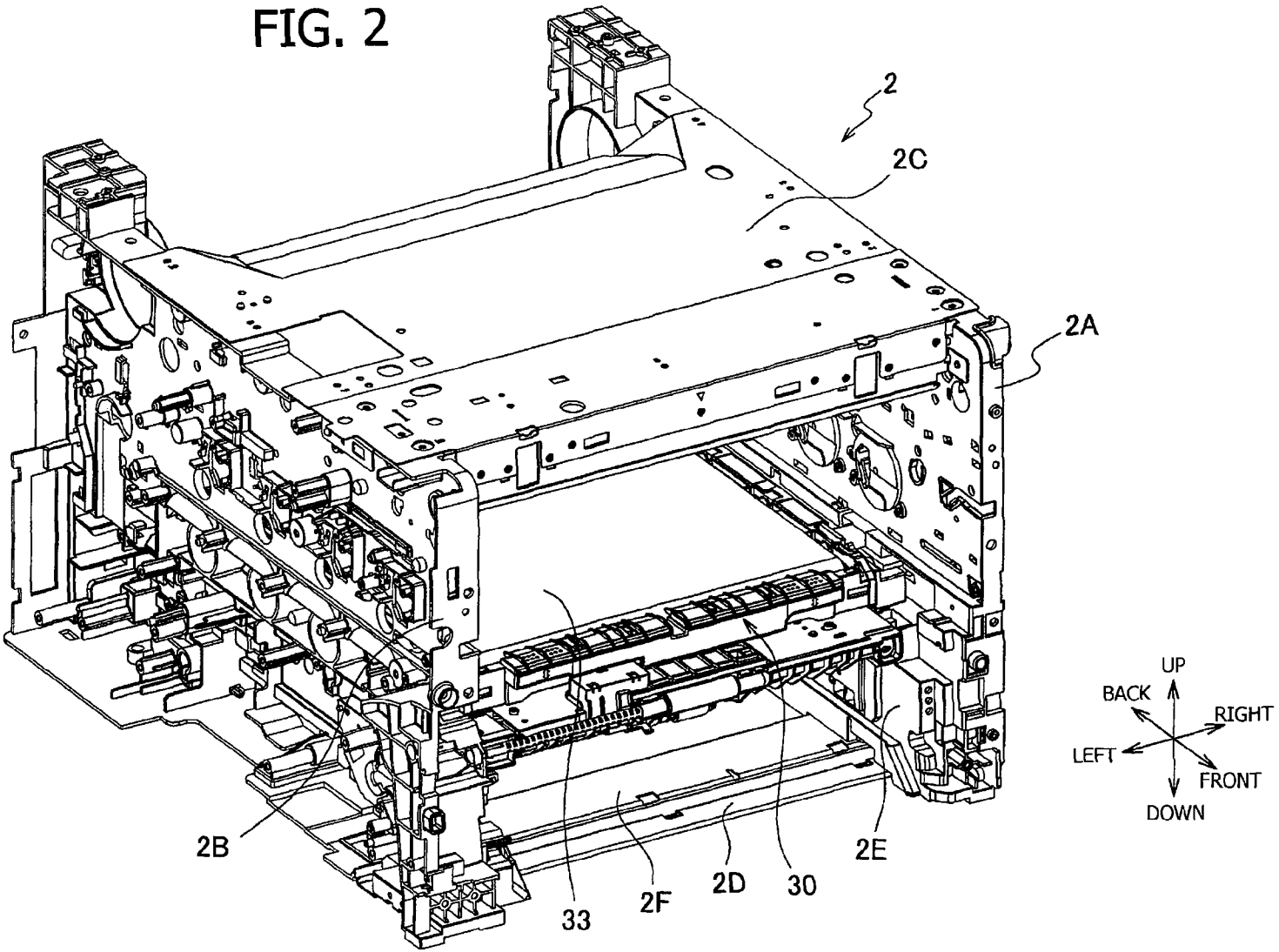
FIG. 2 is a left perspective view of the main body (frame) of the image formation device.

FIG. 1 is a central cross-sectional view showing the principal part of an image formation device 1 in accordance with an embodiment of the present invention. As shown in FIG. 1, the main body (frame) 2 shown in FIG. 2 is covered with a housing 3 which forms the exterior design of the image formation device 1. The top of the housing 3 is formed as a sheet output tray 4, on which sheets (paper, OHP sheets, etc.) ejected from the housing 3 after undergoing printing (image formation) are stacked up.

FIG. 2 is a left perspective view of the main body (frame) 2 of the image formation device 1. As shown in FIG. 2, the main body (frame) 2 includes plate-like side frames 2A and 2B on both sides in the horizontal direction, a top plate 2C connecting the tops of the side frames 2A and 2B together, and a base plate 2D connecting the bases of the side frames 2A and 2B together.

In the main body 2, a storage space 2E, extending in the front-to-back direction while being restricted between the right and left side frames 2A and 2B, is formed. As shown in FIG. 1, an opening 2F at the front end of the storage space 2E can be opened and closed by an open-close door 3A which is attached to the housing 3 to be rotatable.

The main body 2 (i.e. the storage space 2E) stores an image formation unit 10, a feeder unit 20, a belt unit 30, etc. After the image formation (printing) by the image formation unit 10, an intermediate feed roller 40 and an ejection chute (unshown) feed the printed sheet upward while changing the feeding direction by approximately 180 degrees. Thereafter, the printed sheet is ejected to the sheet output tray 4 by an ejection roller 41.

<Feeder Unit>

The feeder unit 20 is a feeding unit for sending out a sheet from a sheet feed tray 21 (explained below) toward the image formation unit 10 as indicated by an arrow in FIG. 1. Specifically, the feeder unit 20 includes the sheet feed tray 21, a sheet feed roller 22, a separation pad 23, etc. The sheet feed tray 21, holding a stack of sheets, is stored in the lowermost part of the main body 2. The sheet feed roller 22, situated above the front end of the sheet feed tray 21, extracts the uppermost sheet from the stack of sheets held in the sheet feed tray 21 and feeds the extracted sheet toward the image formation unit 10. The separation pad 23 helps the uppermost sheet (extracted by the sheet feed roller 22) to separate from the sheet stack by giving prescribed feed resistance to sheets under the uppermost sheet.

<Belt Unit>

Figure 3:
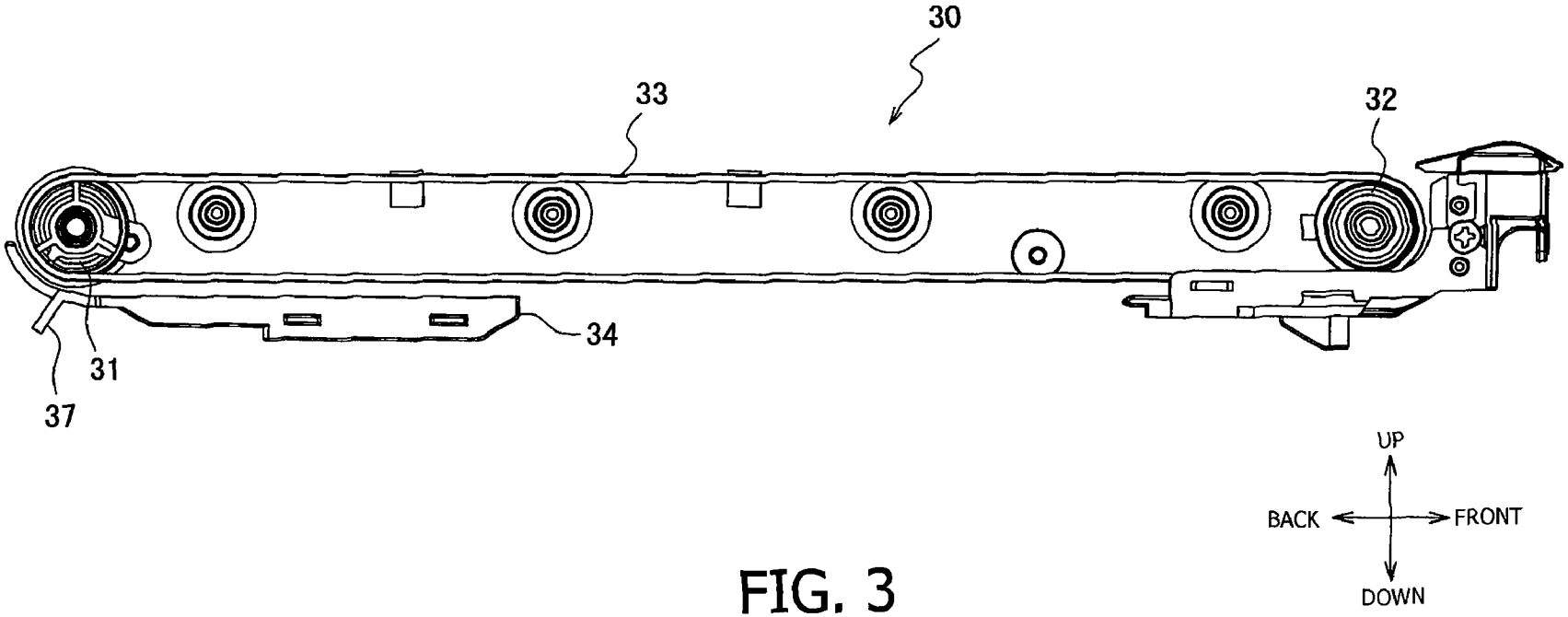
FIG. 3 is a side view of a belt unit of the image formation device.

FIG. 3 is a side view of a belt unit 30 of the image formation device 1. The belt unit 30 is a feeding unit for feeding the sheet supplied from the feeder unit 20. As shown in FIG. 1, the belt unit 30 has been attached to (i.e. installed/loaded/set in) the main body 2 in a detachable manner and thereby placed under a development unit 12 (explained later).

The belt unit 30 includes a drive roller 31 which rotates in conjunction with the operation of the image formation unit 10, a driven roller (tension roller) 32 which is placed apart from the drive roller 31 to be freely rotatable, a feeding belt 33 which is stretched across the drive roller 31 and the driven roller 32, and a belt unit frame 34 (see FIG. 3) which supports the drive roller 31 and the driven roller 32.

The rotating shaft of the drive roller 31 is rotatably supported by the belt unit frame 34 via bearings (unshown) at a fixed position with respect to the belt unit frame 34.

Meanwhile, the rotating shaft of the driven roller 32 (equipped with unshown bearings at both ends) is inserted in and engaged with elongated holes (unshown) formed through the belt unit frame 34 so that the rotating shaft engaging with the belt unit frame 34 can shift toward and away from the drive roller 31.

When the belt unit 30 has been loaded in (set at) a regular loading position in the main body 2, the driven roller 32 is biased in a direction opposite to the drive roller 31 (rightward in FIG. 1) by a tension lever 36 receiving elastic force of an elastic member (e.g. coil spring 35).

As shown in FIG. 1, the belt unit 30 (belt unit frame 34) is formed to have projections 34A projecting toward the side frames 2A and 2B (as parts of the main body 2), respectively. Meanwhile, the side frames 2A and 2B are formed to have engaging parts 2H for contacting and engaging with the projections 34A from the driven roller 32 side when the belt unit 30 has already been loaded in (set at) the regular loading position in the main body 2.

Thus, in the state in which the belt unit 30 has already been loaded in the regular loading position in the main body 2, the belt unit 30 is prevented from moving toward the driven roller 32 side by the engagement of the projections 34A with the engaging parts 2H. In this state, prescribed tension is given to the feeding belt 33 by the driven roller 32 being pressed and biased by the tension lever 36.

Incidentally, the "regular loading position" means a loading position at which normal operation of the belt unit 30 is possible. In an abnormal state in which the belt unit 30 has been set at a position other than the regular loading position, the sheet feeding can not be performed normally and that can result in trouble (e.g. deterioration of print image quality, paper jam, etc.).

<Image Formation Unit>

The image formation unit 10 includes an exposure unit (scanner) 11, the development unit 12, a fixation unit 14, etc. as shown in FIG. 1.

In the image formation unit 10 in accordance with this embodiment, four developing agent cartridges 13K, 13Y, 13M and 13C, storing developing agents (toners) of four colors (black, yellow, magenta, cyan), respectively, are lined up (from the upstream side) in the sheet feed direction (i.e. the direction of the attachment/detachment of the belt unit 30). On the sheet being fed by the belt unit 30, the developing agents (toners) of black, yellow, magenta and cyan are successively overlaid according to image data.

<Exposure Unit>

The exposure unit 11 (in the uppermost part inside the housing 3) is a unit for forming an electrostatic latent image on the surface of each photosensitive drum 13D corresponding to each color (black, yellow, magenta, cyan). Specifically, the exposure unit 11 includes a laser light source, a polygon mirror, an fθ lens, reflecting mirrors, etc. corresponding to each color.

A laser beam emitted by the laser light source (corresponding to a color), having light intensity modulated according to the image data, is periodically scanned (deflected) in a prescribed scanning direction by the polygon mirror (corresponding to the color). The laser beam (modulated according to the image data and periodically scanned in the scanning direction) passes through the fθ lens, is reflected by a reflecting mirror, is then reflected downward by another reflecting mirror, and is incident upon the surface of the photosensitive drum 13D (corresponding to the color). By the process, an electrostatic latent image is formed on the surface of each photosensitive drum 13D corresponding to each color (black, yellow, magenta, cyan).

<Development Unit>

The development unit 12 includes four developing agent cartridges 13K, 13Y, 13M and 13C (hereinafter also referred to generically as "developing agent cartridges 13"). The developing agent cartridges 13 are stored in a drawer casing 12A, and thus the four developing agent cartridges 13 can be attached/detached to/from the main body 2 at once (as one cartridge unit) in this embodiment.

Specifically, developing agents of the four colors CMYK (cyan, magenta, yellow, black) are stored in the developing agent cartridge 13C, 13M, 13Y and 13K, respectively. The four developing agent cartridges 13 (differing only in the color of the developing agent stored therein) have common structure as described below.

In each developing agent cartridge 13, a developing agent storage part 13A includes a developing agent chamber 13B storing the developing agent, rollers (supply roller 13E, development roller 13F) for supplying the developing agent to the photosensitive drum 13D, etc. The developing agent stored in the developing agent chamber 13B is supplied to the development roller 13F by the rotation of the supply roller 13E and is held on the surface of the development roller 13E The thickness of the developing agent held on the surface of development roller 13F is regulated at a prescribed constant (even) thickness by a layer thickness regulator blade 13G. Thereafter, the developing agent on the development roller 13F is supplied to the surface of the photosensitive drum 13D which has undergone the exposure (i.e. formation of the electrostatic latent image) by the exposure unit 11.

The photosensitive drum 13D (serving as an image holding unit for holding the image to be transferred to the sheet) is a cylindrical drum whose surface layer is formed of a positive-charging photosensitive layer (polycarbonate, etc.). A charging unit 13H is used for charging (electrifying) the surface of the photosensitive drum 13D.

An image transfer roller 13J is situated to face the photosensitive drum 13D across the feeding belt 33. The image transfer roller 13J, rotating in conjunction with the turning of the feeding belt 33, transfers the developing agent (image) on the photosensitive drum 13D to the print surface of the sheet when the sheet passes by (under) the photosensitive drum 13D, by applying/exerting prescribed voltage (of a polarity opposite to that of the electrical charges on the photosensitive drum 13D) to/on the sheet. In this embodiment, each image transfer roller 13J (corresponding to each of the developing agent cartridges 13K, 13Y, 13M and 13C) is attached to the belt unit 30 (belt unit frame 34) to be rotatable.

Incidentally, the main body 2 has a guide rail 2G which guides the development unit 12 to its regular loading position by guiding (making sliding contact with) a guide roller 12B at the rear end (i.e. front end in the loading direction) of the drawer casing 12A (development unit 12).

<Fixation Unit>

The fixation unit 14, situated on the downstream side of the photosensitive drums 13D in regard to the sheet feed direction, fixes the developing agents (image) transferred to the sheet by means of heat fusing. The fixation unit 14 has also been attached to the main body 2 in a detachable manner.

The fixation unit 14 includes a heating roller 14A, a pressure roller 14B, etc. The heating roller 14A (situated to face the print surface of the sheet) exerts the feeding force on the sheet while heating the developing agents (image) on the sheet. The pressure roller 14B (situated to face the heating roller 14A across the sheet) presses the sheet against the heating roller 14A.

<Sensor for Calibration Adjustment and Detection of Belt Unit>

<Mechanical Configuration>

The "calibration adjustment" means adjustment of characteristics of components of the image formation unit 10 in order to standardize the colors by correcting variations among the colors.

In the calibration adjustment, a developing agent image for the calibration adjustment (hereinafter referred to as a "patch mark") regarding each developing agent cartridge 13 (i.e. each color) is transferred to the feeding belt 33, density (color density) of the transferred patch mark (in each color) is detected by a density sensor 50 (see FIG. 1), and the characteristics of the components of the image formation unit 10 are adjusted based on the density (of each color) detected by the density sensor 50. Specifically, the density sensor 50 includes a light emitting unit and a light receiving unit. The light emitting unit emits light to an object and the light receiving unit receives the light reflected by the object to detect intensity of the received light.

As shown in FIG. 1, the density sensor 50 (fixed with respect to the main body 2 at a position on the drive roller 31 side (i.e. front end in the loading direction) of the belt unit 30) detects the density of each patch mark on the feeding belt 33 at the position corresponding to the drive roller 31.

Figure 4B:
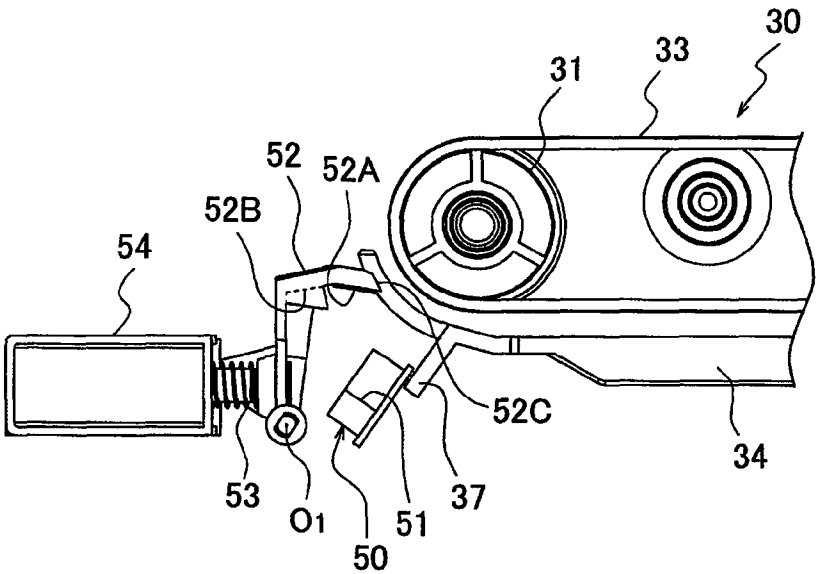
FIGS. 4A and 4B are enlarged views of a part A shown in FIG. 1 for explaining a first position and an open position of a protective cover of the image formation device.
Figure 4A:
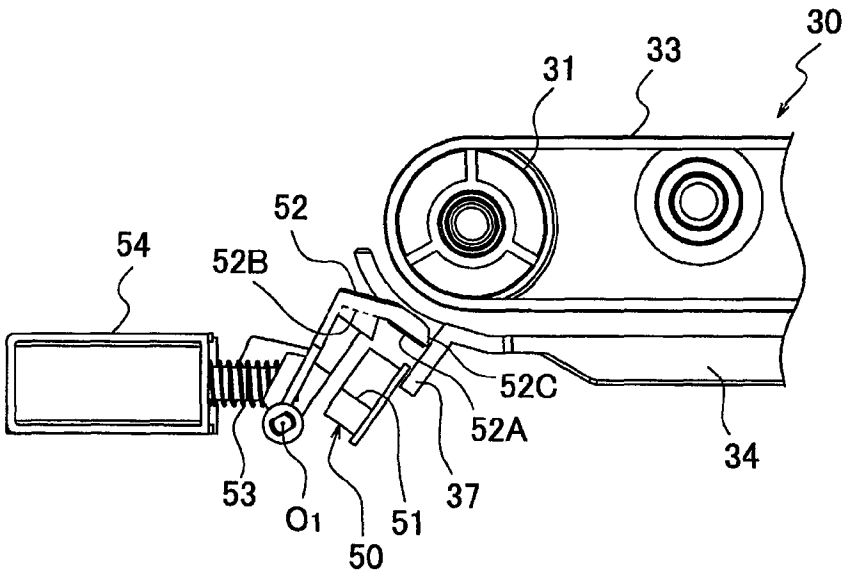
Figure 5B:
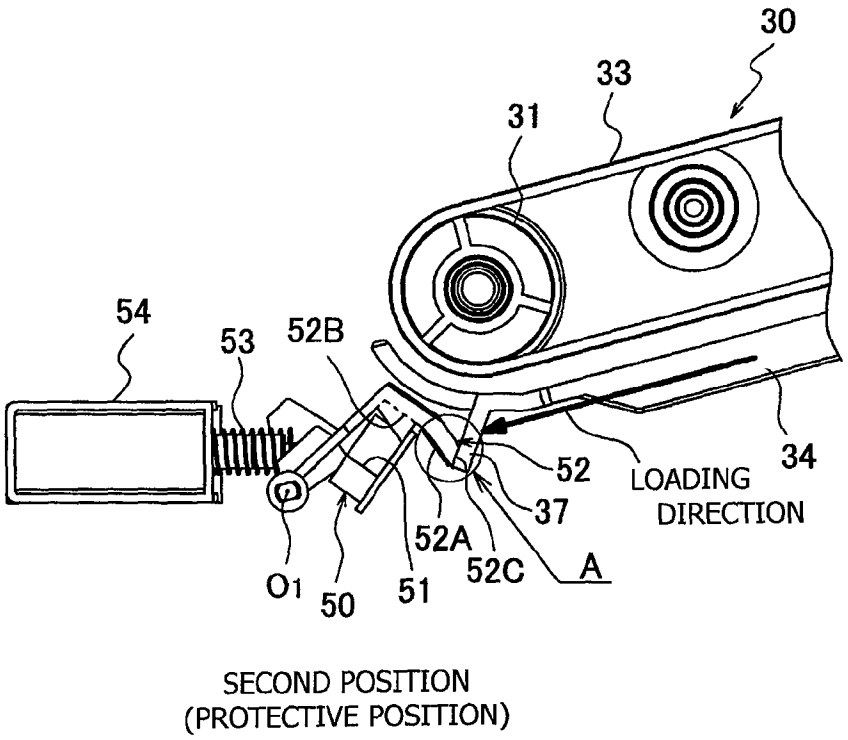
FIGS. 5A and 5B are enlarged views of the part A shown in FIG. 1 for explaining a second position of the protective cover.
Figure 5A:
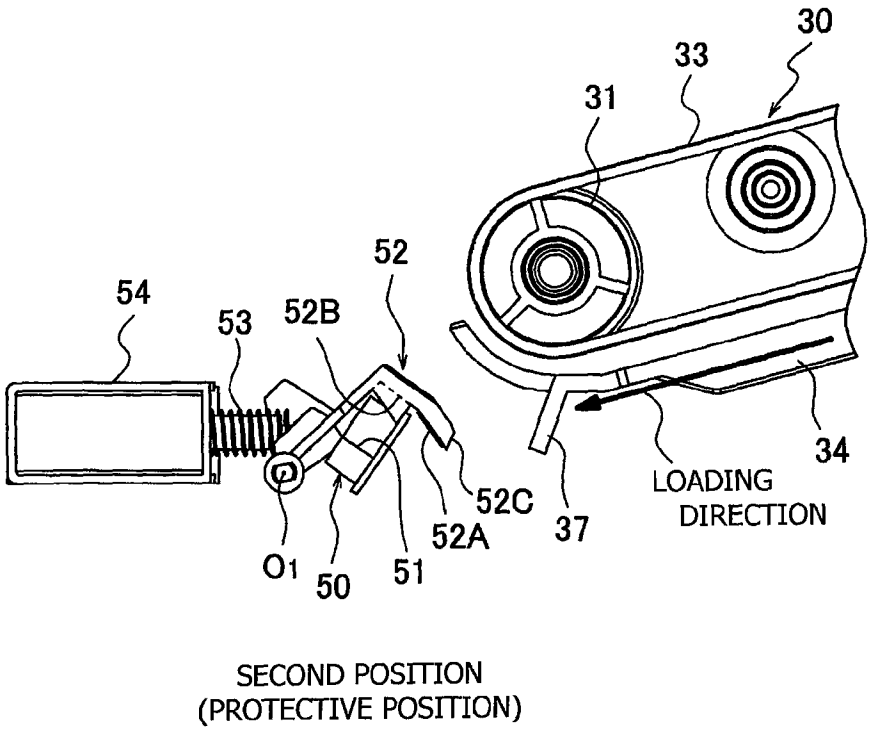

FIGS. 4A and 4B are enlarged views of a part A shown in FIG. 1 for explaining a first position and an open position of a protective cover 52 of the image formation device 1. FIGS. 5A and 5B are enlarged views of the part A shown in FIG. 1 for explaining a second position of the protective cover. The density sensor 50 is a reflective optical sensor of a well-known type, including a detector unit 51 having a light emitting unit and a light receiving unit (photoreceptor unit). When the detector unit 51 of the density sensor 50 is not used for detecting the density of the patch mark transferred to the feeding belt 33, the detector unit 51 is covered by the protective cover 52 as shown in FIG. 4A and thereby protected from dust, toner, etc. floating inside the main body 2.

The protective cover 52 is capable of swinging around a swing axis O1 (fixed with respect to the main body 2) and shifting between a protective position for covering the detector unit 51 (see FIGS. 4A and 5B) and an open position for uncovering the detector unit 51 and letting it directly face the feeding belt 33 (see FIGS. 4B).

Further, as shown in FIG. 4A, a first reflecting part 52A and a second reflecting part 52B differing in reflectivity are formed in a part of the protective cover 52 facing the detector unit 51 when the protective cover 52 is at the protective position.

At the protective position, the protective cover 52 is capable of slightly swinging (shifting) between a first position for letting the first reflecting part 52A face the detector unit 51 (see FIGS. 4A) and a second position for letting the second reflecting part 52B face the detector unit 51 (see FIGS. 5A). In short, the swinging protective cover 52 can be placed at three positions: the first position (protective position), the second position (protective position) and the open position.

A spring 53 exerts its elastic force on the protective cover 52 to bias the protective cover 52 toward the second position. On the other hand, when the belt unit 30 is attached to the main body (frame) 2 as shown in FIGS. 5A, 5B and 4A, a pressing part 37 of the belt unit frame 34 (belt unit 30) presses the protective cover 52 toward the first position.

Thus, when the belt unit 30 has not been attached to the main body 2 yet, the protective cover 52 (receiving the elastic force of the spring 53) is placed at the second position (with the second reflecting part 52B facing the detector unit 51) as shown in FIG. 5A.

When the belt unit 30 is attached to the main body 2, the protective cover 52 is pressed by the pressing part 37 (belt unit 30) toward the first position as shown in FIG. 5B. When the belt unit 30 has already been loaded in the regular loading position, the protective cover 52 is situated at the first position (with the first reflecting part 52A facing the detector unit 51) as shown in FIG. 4A.

As above, the image formation device 1 of this embodiment includes the protective cover 52 (for covering the detector unit 51 of the density sensor 50) rotatably attached to the main body 2, the spring 53 for pressing the protective cover 52 toward the second position, and the pressing part 37 for pressing the protective cover 52 toward the first position when the belt unit 30 is attached to the main body 2. The spring 53 and the pressing part 37 form a shifting unit for shifting the protective cover 52 relative to the density sensor 50 mechanically in conjunction with the attachment/detachment of the belt unit 30.

The actuator 54 is used for shifting the protective cover 52 from the protective position (first position) to the open position. When the calibration adjustment is performed, the protective cover 52 is placed at the open position (see FIG. 4B) by energizing the actuator 54. When the calibration adjustment is finished or unnecessary, the protective cover 52 is placed at the protective position (see FIG. 4A) by use of the elastic force of the spring 53, without energizing the actuator 54.

Figure 7A:
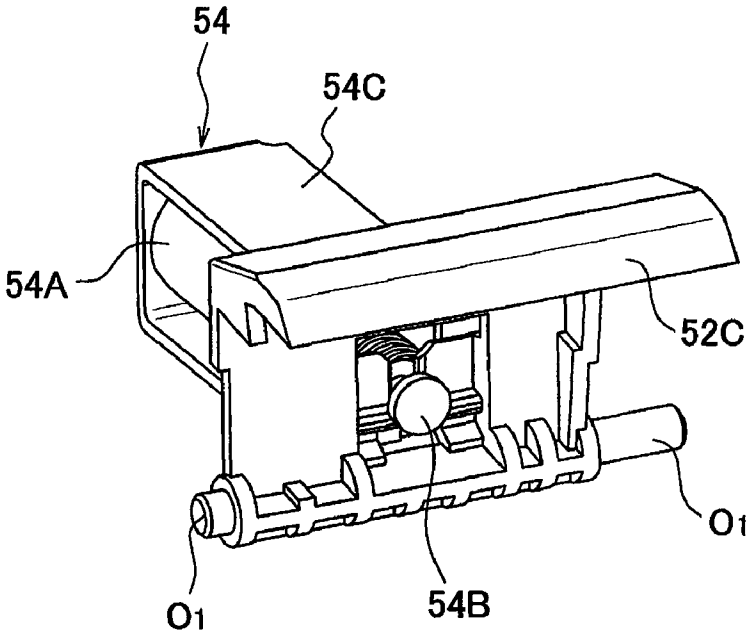
FIG. 7A is a front perspective view of the protective cover and an actuator.
Figure 7B:
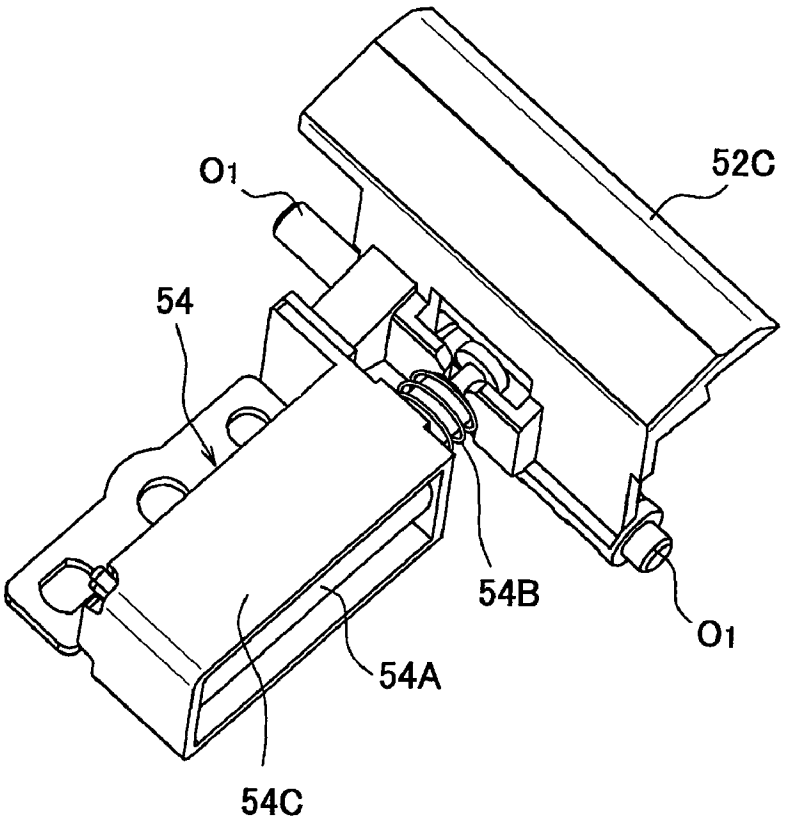
FIG. 7B is a top perspective view of the protective cover and the actuator.
Figure 8:
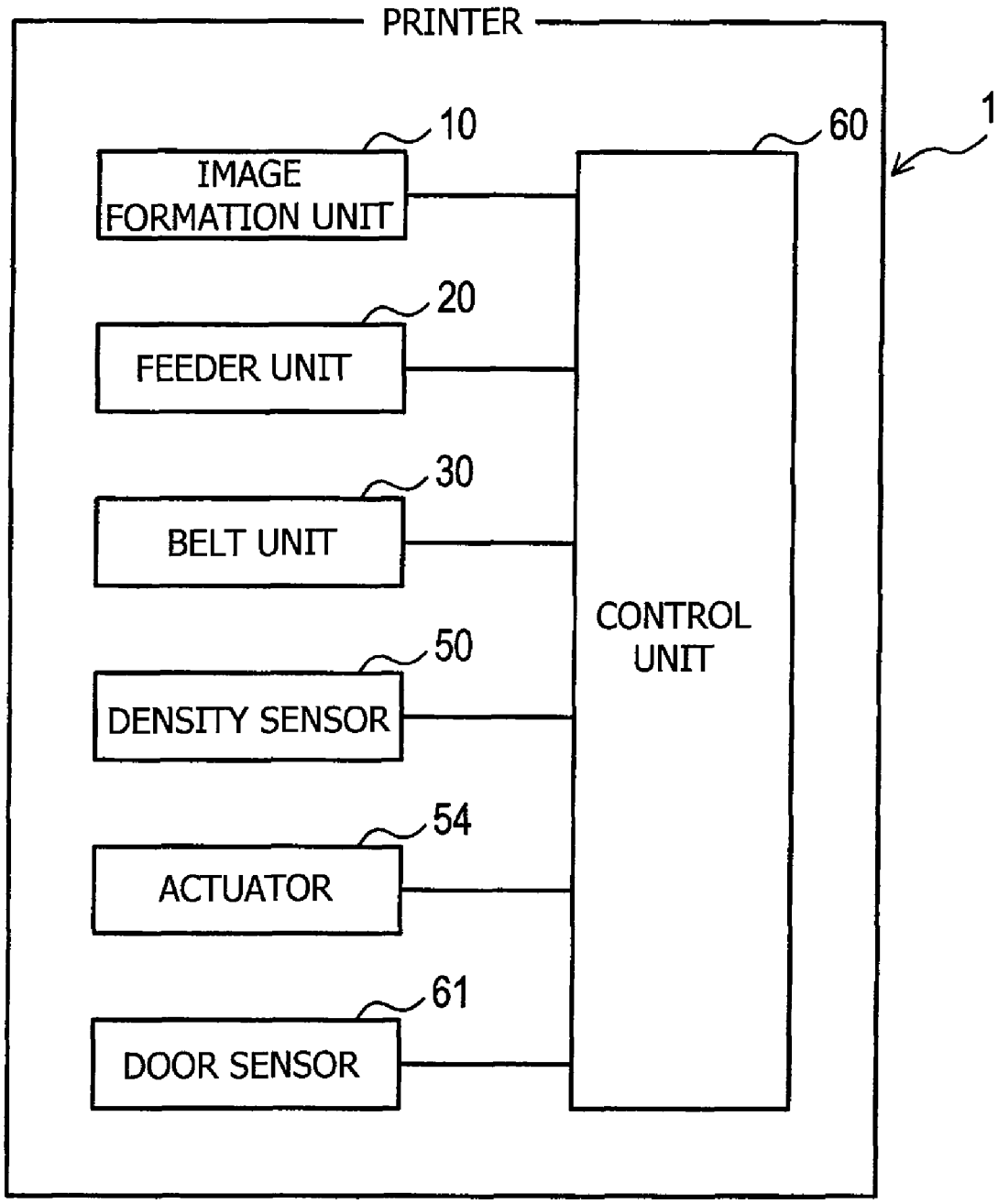
FIG. 8 is a block diagram showing the electrical configuration of the image formation device in accordance with the embodiment.

FIG. 7A is a front perspective view of the protective cover 52 and an actuator 54. FIG. 7B is a top perspective view of the protective cover 52 and the actuator 54. FIG. 8 is a block diagram showing the electrical configuration of the image formation device 1 in accordance with the embodiment. As shown in FIGS. 7A and 7B, the actuator 54 in this embodiment is an electromagnetic actuator including a solenoid coil 54A, a movable part (plunger) 54B which is movable inside the solenoid coil 54A in its axial direction, and a yoke (housing) 54C which forms a magnetic path.

In this embodiment, the first reflecting part 52A is equipped with a reference reflector plate which is usable for calibration adjustment. Even when the aforementioned calibration adjustment (using the patch marks) is not performed (i.e. when the protective cover 52 is at the first position), the density sensor 50 is put into operation and the output of the density sensor 50 is corrected (adjusted) by use of the reference reflector plate (first reflecting part 52A). The reference reflector plate is a reflector plate on which a reference reflective image has been formed. The "reference reflective image" means an image which can be used as the reference for the calibration adjustment. The "image" can have a pattern (which can include one or more characters, symbols, figures, etc.), color, or a combination of them.

Each of the first and second reflecting parts 52A and 52B is formed as a flat surface (with no convexities/concavities) as shown in FIG. 4A. When the protective cover 52 is at the first position, the plane (flat surface) of the first reflecting part 52A is orthogonal to a first virtual plane which contains the optical axis of the beam emitted from the light emitting unit of the detector unit 51 and the optical axis of the beam reflected by the first reflecting part 52A. When the protective cover 52 is at the second position, the plane (flat surface) of the second reflecting part 52B is orthogonal to a second virtual plane which contains the optical axis of the beam emitted from the light emitting unit and the optical axis of the beam reflected by the second reflecting part 52B.

A part 52C of the protective cover 52 making contact with the pressing part 37 (hereinafter referred to as a "pressed part 52C") is formed as a tilted surface that is tilted with respect to the loading direction of the belt unit 30 as shown in FIG. 5B. The pressing part 37 of the belt unit frame 34 is also formed as a tilted surface (tilted with respect to the loading direction of the belt unit 30).

Incidentally, the "loading direction of the belt unit 30" means the moving direction of the belt unit 30 when it is loaded into the main body 2 (see FIGS. 5A and 5B).

<Electrical Configuration>

The electrical configuration (electrical system) of the image formation device 1 of this embodiment is shown in the block diagram of FIG. 8. As shown in FIG. 8, not only the output of the density sensor 50 but also a detection signal from a door sensor 61 (detecting the open/closed state of the open-close door 3A) is inputted to a control unit 60 which controls the image formation unit 10, the actuator 54, etc.

<Characteristics of Image Formation Device of Embodiment>

In order to detach the belt unit 30 from the main body (frame) 2, the user has to open the open-close door 3A as mentioned above. Thus, when the closing of the open-close door 3A is detected by the door sensor 61 after detecting the opening of the open-close door 3A, it is highly likely that the belt unit 30 has been detached and/or attached.

Therefore, the image formation device 1 of this embodiment puts the density sensor 50 into operation and executes control for judging whether the belt unit 30 has been set at the regular loading position or not when the closing of the open-close door 3A is detected by the door sensor 61 after the opening of the open-close door 3A is detected by the door sensor 61, when the power of the image formation device 1 is turned ON, and when the printing (image formation) is started (i.e. when a print instruction is received).

Specifically, when the belt unit 30 has already been set at the regular loading position, the protective cover 52 is situated at the first position. In this case, the beam emitted from the light emitting unit of the detector unit 51 is reflected by the first reflecting part 52A and then received by the light receiving unit (photoreceptor unit) of the detector unit 51.

On the other hand, when the belt unit 30 has not been set at the regular loading position yet, the protective cover 52 is situated at the second position. In this case, the beam emitted from the light emitting unit is reflected by the second reflecting part 52B and then received by the light receiving unit (photoreceptor unit).

Since the density detected by the density sensor 50 varies depending on whether the belt unit 30 has already been attached to the main body 2 or not as above, the judgment on whether the belt unit 30 has been attached (i.e. set at the regular loading position) or not can be made based on the difference in the detected value.

Further, variation (deterioration) of the first and second reflecting parts 52A and 52B with time is far less than that of the belt unit 30 since the first and second reflecting parts 52A and 52B are a part of the protective cover 52 covering the detector unit 51 of the density sensor 50 and are not used during the image formation.

As above, in the image formation device 1 of this embodiment, whether the belt unit 30 has been attached or not can be detected by use of an already-existing density sensor 50, without being seriously affected by the variation (deterioration) of the belt unit 30 with time.

Incidentally, while both the pressing part 37 of the belt unit frame 34 and the pressed part 52C of the protective cover 52 are formed as tilted surfaces (tilted with respect to the loading direction of the belt unit 30) in this embodiment, the pressing part 37 and pressed part 52C may be formed differently. For example, it is possible to form one of the pressing part 37 and the pressed part 52C as a tilted surface.

Since at least one of the pressing part 37 (of the belt unit frame 34) and the pressed part 52C (of the protective cover 52) is formed to have a surface tilted with respect to the loading direction of the belt unit 30 in this embodiment, force in a direction appropriate for swinging the protective cover 52 toward the first position can be generated (applied to the protective cover 52) by use of force of the user for attaching the belt unit 30 to the main body 2.

Figure 6:
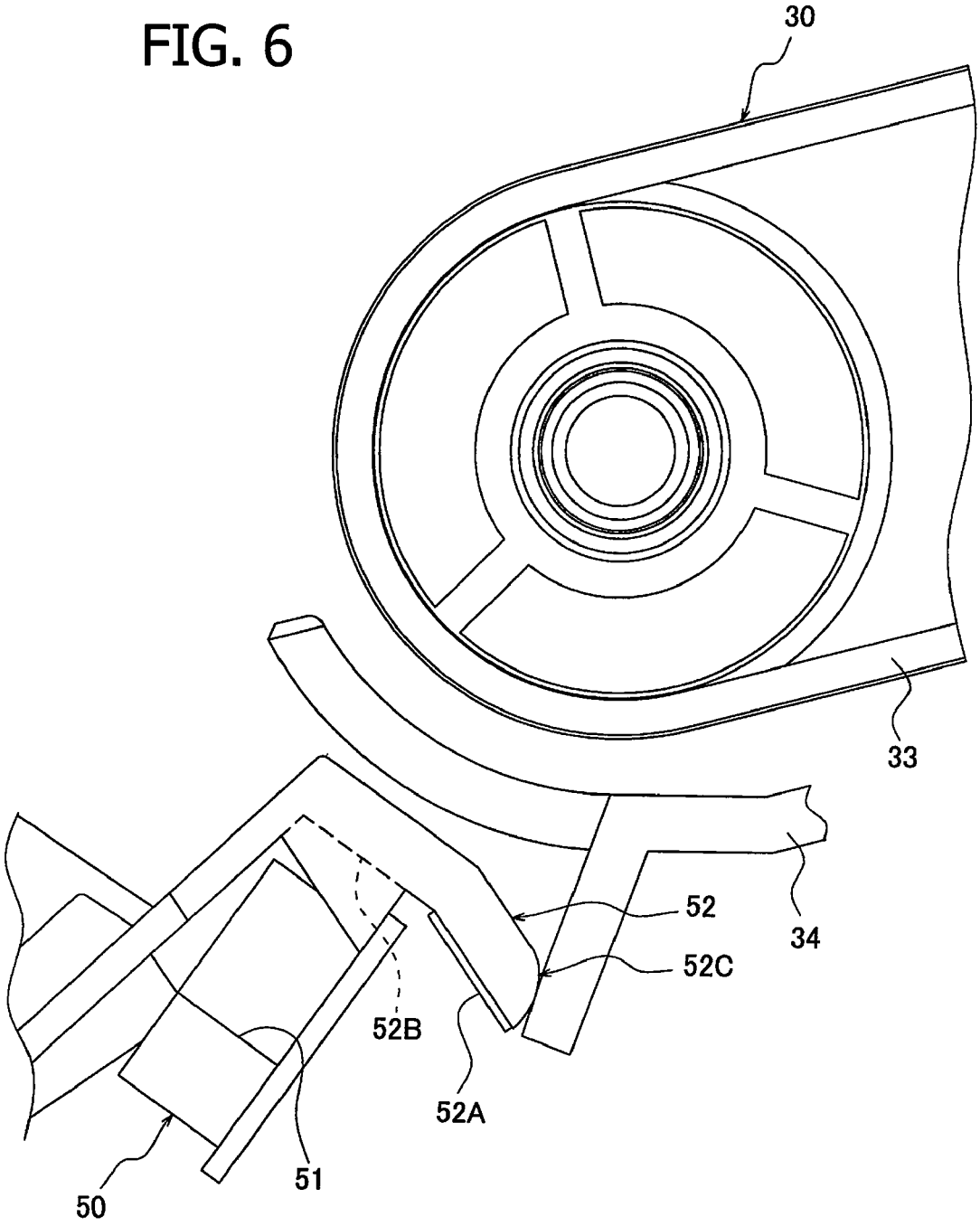
FIG. 6 is an enlarged view of a part Al shown in FIG. 5B.

FIG. 6 is an enlarged view of a part A1 shown in FIG. 5B. Since the pressed part 52C in this embodiment is formed as a curved surface as shown in FIG. 6, the pressed part 52C can smoothly slide along the pressing part 37, by which the protective cover 52 can be moved (swung) smoothly and reliably. Incidentally, the above expression "formed as a curved surface" means that the surface of the pressed part 52C has a curved shape in a macroscopic sense (when visually observed).

The protective cover 52, capable of the smooth and reliable swinging motion, can be shifted from the second position to the first position without fail in conjunction with the attachment of the belt unit 30 to the main body 2.

Since each of the first and second reflecting parts 52A and 52B is formed as a flat surface in this embodiment, the beam emitted from the light emitting unit of the detector unit 51 can be reflected toward the light receiving unit (photoreceptor unit) with reliability by the first reflecting part 52A or the second reflecting part 52B, by which the attachment of the belt unit 30 to the main body 2 can be detected by the density sensor 50 without fail. Incidentally, the above expression "formed as a flat surface" means that the surface of each reflecting part (52A, 52B) is a flat surface in a macroscopic sense (when visually observed). The condition "flat surface" is satisfied even when the surface of a reflecting part (52A, 52B) has a convexity/concavity or curved part in a microscopic sense, as long as the above effects are achieved.

Since the first reflecting part 52A is formed so that its plane (flat surface) becomes orthogonal to the first virtual plane (containing the optical axis of the beam emitted from the light emitting unit of the detector unit 51 and the optical axis of the beam reflected by the first reflecting part 52A) when the protective cover 52 is at the first position and the second reflecting part 52B is formed so that its plane (flat surface) becomes orthogonal to the second virtual plane (containing the optical axis of the beam emitted from the light emitting unit and the optical axis of the beam reflected by the second reflecting part 52B) when the protective cover 52 is at the second position in this embodiment, the beam emitted from the light emitting unit can be reflected toward the light receiving unit (photoreceptor unit) with reliability by the first reflecting part 52A or the second reflecting part 52B.

Since the first reflecting part 52A of the protective cover 52 is equipped with the reference reflector plate which is usable for the calibration adjustment, it is unnecessary to provide the image formation device 1 with a special reference reflector plate specifically for the calibration adjustment, by which the number of components of the image formation device 1 and the number of assembling processes can be reduced.

<Modifications>

While the protective cover 52 is shifted (relative to the density sensor 50) mechanically in conjunction with the attachment/detachment of the belt unit 30 in the above embodiment, the shifting of the protective cover 52 may be implemented differently (e.g. electrically).

While the protective cover 52 is moved by swinging it in the above embodiment, the protective cover 52 may be moved in different ways, such as parallel translation (reciprocation) in the loading direction of the belt unit 30.

While the protective cover 52 (for covering the density sensor 50) is shifted in conjunction with the attachment/detachment of the belt unit 30 in the above embodiment, it is also possible, for example, to shift the density sensor 50 in conjunction with the attachment/detachment of the belt unit 30.

While the density sensor 50 is situated on the drive roller 31 side of the belt unit 30 in the above embodiment, the position of the density sensor 50 may be changed.

While the loading direction of the belt unit 30 is set as a horizontal direction in the above embodiment, the loading direction may be set differently (e.g. vertical direction).

While the first reflecting part 52A of the protective cover 52 is equipped with the reference reflector plate for the calibration adjustment in the above embodiment, it is possible to change the configuration of the first reflecting part 52A or the position of the reference reflector plate.

While the feeding belt 33 is employed as an image transfer member (to which the developing agent can be transferred) in the above embodiment, the image transfer member is not restricted to such a feeding belt. For example, in an image formation device equipped with an intermediate rotating/rolling member for image transfer (e.g. intermediate image transfer belt), the intermediate image transfer rotating/rolling member can be employed as the image transfer member.

While a scanner that periodically scans (deflects) a laser beam in a prescribed scanning direction is employed for the exposure unit 11 in the above embodiment, the exposure unit 11 may be configured differently. For example, a scanner that exposes the photosensitive drum 13D by ON-OFF control of a large number of LEDs can also be employed for the exposure unit 11.

While a description has been given above of a preferred embodiment in accordance with the present invention, the present invention is not to be restricted by the particular illustrative embodiment and a variety of modifications, design changes, etc. are possible without departing from the scope and spirit of the present invention described in the appended claims.

What is claimed is:

1. An image formation device of an electrophotographic type for forming an image on a sheet by transferring a developing agent to the sheet, comprising:

an image transfer unit which is attached to a main body of the image formation device in a detachable manner and includes an image transfer member to which the developing agent can be transferred;

a density detecting unit which includes a detector unit having a light emitting unit and a light receiving unit and thereby detects density of the developing agent transferred to the image transfer member;

a protective cover which protects the density detecting unit by covering the detector unit when the density detecting unit does not detect the density of the developing agent transferred to the image transfer member;

a first reflecting part and a second reflecting part differing in reflectivity which are formed in a part of the protective cover facing the detector unit when the protective cover covers the detector unit; and a shifting unit which shifts the protective cover relative to the density detecting unit in conjunction with attachment/detachment of the image transfer unit to/from the main body, wherein the shifting unit places the protective cover at a first position for letting the first reflecting part face the detector unit when the image transfer unit has been attached to the main body, while placing the protective cover at a second position for letting the second reflecting part face the detector unit when the image transfer unit has not been attached to the main body.

2. The image formation device according to claim 1, wherein:

the density detecting unit is fixed with respect to the main body, and the protective cover is capable of shifting relative to the main body, and the image formation device further comprises a biasing unit which biases the protective cover toward the second position, and the image transfer unit is equipped with a pressing part which presses the protective cover toward the first position when the image transfer unit is attached to the main body.

3. The image formation device according to claim 2, wherein the biasing unit includes a spring which exerts elastic force on the protective cover to bias the protective cover toward the second position.

4. The image formation device according to claim 2, wherein:

the protective cover is capable of swinging relative to the main body, and at least one of the pressing part and a pressed part of the protective cover making contact with the pressing part has a surface tilted with respect to a loading direction of the image transfer unit.

5. The image formation device according to claim 4, wherein the surface tilted with respect to the loading direction of the image transfer unit is formed as a curved surface.

6. The image formation device according to claim 1, wherein each of the first and second reflecting parts is formed as a flat surface.

7. The image formation device according to claim 6, wherein:

the flat surface of the first reflecting part is orthogonal to a first virtual plane which contains an optical axis of a beam emitted from the light emitting unit and an optical axis of the beam reflected by the first reflecting part when the protective cover is at the first position, and the flat surface of the second reflecting part is orthogonal to a second virtual plane which contains the optical axis of the beam emitted from the light emitting unit and an optical axis of the beam reflected by the second reflecting part when the protective cover is at the second position.

8. The image formation device according to claim 1, wherein the first reflecting part is provided with a reference reflective image which can be used for calibration adjustment.

9. The image formation device according to claim 1, wherein the image transfer member is a feeding belt which feeds the sheet for the transfer of the developing agent to the sheet and to which the developing agent can be transferred.

10. The image formation device according to claim 1, further comprising an actuator which shifts the protective cover to an open position for letting the detector unit directly face the image transfer member for the detection of the density of the developing agent transferred to the image transfer member.

11. An image formation device of an electrophotographic type for forming an image on a sheet by transferring a developing agent to the sheet, comprising:

a density sensor including a light emitting unit and a light receiving unit;

a belt unit configured to be detachably attached to a main body of the image formation device, the belt unit including:

a belt to which the developing agent can be transferred; and a pressing part;

a cover movable with respect to the density sensor, the cover including:

a pressed part, the cover moving when the pressed part is pressed; and a first reference surface and a second reference surface which is provided on a surface facing the light emitting unit;

a spring configured to urge the cover toward a position at which the light emitted by the light emitting unit of the density sensor is incident on the second reference surface, wherein, when the belt unit is loaded, the pressing part of the belt unit presses the pressed part of the cover to move the cover toward a position at which the light emitted by the light emitting unit of the density sensor is incident on the first reference surface, and wherein, when the belt unit is not loaded, the spring moves the cover to a position where light emitted by the light emitting unit of the density sensor is incident on the second reference surface.

12. The image formation device according to claim 11, further comprising an actuator which is configured to move the cover to a position at which the light emitted by the light emitting unit of the density sensor unit is not incident on the cover.

13. The image formation device according to claim 11, wherein an image used for calibration of the density sensor is formed on the first reference surface.

* * * * *